US010301832B1

(12) United States Patent
Shoberg

(10) Patent No.: US 10,301,832 B1
(45) Date of Patent: May 28, 2019

(54) PLASTER APPLICATOR DEVICE WITH FILLING TUBE AND RELATED METHODS

(71) Applicant: Donald Shoberg, Cypress, TX (US)

(72) Inventor: Donald Shoberg, Cypress, TX (US)

( * ) Notice: Subject to any disclaimer, the term of this patent is extended or adjusted under 35 U.S.C. 154(b) by 206 days.

(21) Appl. No.: 15/294,268

(22) Filed: Oct. 14, 2016

Related U.S. Application Data

(60) Provisional application No. 62/241,710, filed on Oct. 14, 2015.

(51) Int. Cl.

| | |
|---|---|
| ***E04F 21/08*** | (2006.01) |
| ***B05C 17/00*** | (2006.01) |
| ***B05C 17/005*** | (2006.01) |
| ***B05C 17/01*** | (2006.01) |
| ***E04F 21/165*** | (2006.01) |

(52) U.S. Cl.
CPC ..... *E04F 21/08* (2013.01); *B05C 17/002* (2013.01); *B05C 17/00516* (2013.01); *B05C 17/0116* (2013.01); *B05C 17/0146* (2013.01); *E04F 21/1655* (2013.01)

(58) Field of Classification Search
CPC ..... B05C 17/002; B05C 17/00516; B05C 17/0116; B05C 17/0146; E04F 21/1655; E04F 21/08; E04F 21/06; E04F 21/165; E04F 21/16; E04F 21/02
See application file for complete search history.

(56) References Cited

U.S. PATENT DOCUMENTS

| | | | | |
|---|---|---|---|---|
| 3,070,827 A * | 1/1963 | Ames | B05C 17/00516 | 222/174 |
| 3,231,139 A * | 1/1966 | Bouet | A61M 3/00 | 221/249 |
| 6,120,203 A * | 9/2000 | Modders | B05C 17/003 | 401/139 |
| 6,155,809 A * | 12/2000 | Edwards | B05C 17/00503 | 15/235.7 |
| 8,449,214 B1 * | 5/2013 | Shoberg | B05C 17/00516 | 401/179 |
| 9,133,631 B2 * | 9/2015 | Jungklaus | B25G 1/10 | |

* cited by examiner

*Primary Examiner* — David J Walczak
(74) *Attorney, Agent, or Firm* — IPTechLaw

(57) ABSTRACT

A plaster applicator may include: a first sleeve, a tube slidably received within the first sleeve. An applicator head may be coupled at the first end of the tube and include an applicator tube coupled in an applicator hole in the applicator head. A first valve may be operably connected within the applicator head. A filling tube may be coupled in a filling opening in the applicator head. The applicator may also include a second one-way valve operably connected within the filling tube in the applicator.

20 Claims, 10 Drawing Sheets

PLASTER APPLICATOR DEVICE WITH FILLING TUBE AND RELATED METHODS

CROSS REFERENCE TO RELATED APPLICATIONS

This document claims the benefit of the filing date of U.S. Provisional Patent Application 62/241,710, entitled "Plaster Applicator with Filler and Related Methods" to Donald Shoberg which was filed on Oct. 14, 2015, the disclosure of which is hereby incorporated entirely herein by reference.

BACKGROUND

1. Technical Field

Aspects of this document relate generally to plaster applicators. More specific implementations involve plaster applicators for applying plaster to the exterior surface of walls.

2. Background

Plaster is a material used on the outer surface of a wall in a structure to fill in and smooth out the gaps between panels and to provide texture to the surface of the wall. Also called "mud" or "joint compound", plaster can be plaster of Paris, lime plaster or cement plaster. The base materials are mixed with water and other additives as desired to form a thick mixture of mud which, once applied, initiates an exothermic chemical reaction, eventually hardening the mud into a solid form. A plaster applicator is disclosed in U.S. Pat. No. 8,449,214, titled "Corner Plaster Applicator," naming as first inventor Donald Shoberg, issued May 28, 2013 (hereinafter the '214 patent), the disclosure of which is hereby incorporated entirely herein by reference.

SUMMARY

Implementations of a plaster applicator with filler may include: a first sleeve, a tube slidably received within the first sleeve, a piston coupled to the first sleeve through a connector, the piston slidably located within the tube so that a sliding movement of the sleeve along the tube creates a sliding movement of the piston within the tube where the connector extends over a pulley mounted at a first end of the tube and through a hole in the tube proximate to the pulley. The applicator may further include an applicator head coupled at the first end of the tube, the applicator head including an applicator tube coupled in an applicator hole in the applicator head, and the applicator tube configured to provide liquid communication between the interior and the exterior of the tube for plaster comprised in the tube. The applicator may include a first valve operably connected within the applicator head, the valve restricting fluid flow of plaster between an interior and an exterior portion of an applicator head, and a filling tube coupled in a filling opening in the applicator head, the filling tube configured to provide liquid communication between the interior and the exterior of the tube. The applicator may also include a second one-way valve operably connected within the filling tube in the applicator, the second one-way valve configured to allow flow of plaster into the filling tube and prevent flow of plaster out of the filling tube depending on the position of the second one-way valve. A plastering wedge may be included which is removably coupled at an end of the applicator tube opposing an end of the applicator tube coupled at the applicator hole.

Implementations of plaster applicators like those disclosed herein may include one, all, or any of the following:

The plaster applicator device may have a second sleeve which may be coupled to the tube thereby preventing movement of the first sleeve along the tube beyond the position of the second sleeve.

A wire may be the connector.

A gasket which may be coupled to the piston thereby preventing liquid communication between the front and the rear of the piston.

The applicator head may include a cone shaped portion, the applicator hole being positioned at the tip of the cone shaped portion.

The applicator tube may have a rounded tip and the plastering wedge may releasably snap fit over the rounded tip.

The first valve may be a ball-type valve which rotatably restricts fluid flow of plaster between an interior and an exterior portion of an applicator head.

The filling tube may include a cross member axially attached to the interior of the filling tube, a stopper, wherein the shaft of the stopper is concentrically received within the filling tube and passes through a hole within the cross member, a spring disposed around the stopper shaft, and a nut threadably coupled onto the stopper shaft, where the nut and the cross member retain the spring around the stopper shaft.

The filling tube may be disposed off-axis from an axis of the applicator tube.

An applicator rod may be operably attached to the piston, and move along with the piston in such a way that as the piston moves within the tube, the application rod moves correspondingly internally within the tube, the opposite end of the rod sliding in and out of the inside of the tube.

Implementations of an applicator head for a plaster applicator device may include a cone shaped portion including an applicator hole positioned at an end of the cone shaped portion, the cone shaped portion coupled to a cylindrical portion and the cylindrical portion configured to be mounted to a first end of a tube. The applicator hole may include an applicator tube therein where the applicator tube is configured to allow liquid communication for plaster between the interior and the exterior of the tube. A first valve may be included that is operably connected within the applicator head where the first valve restricts fluid flow of plaster between an interior and an exterior portion of an applicator head. A filling tube may be coupled in a filling opening in the cone shaped portion where the filling tube may be configured to permit liquid communication for plaster between the interior and exterior of the cone shaped portion. A second one-way value may be coupled in the filling tube where the one-way value is configured to allow flow of plaster into the filling tube and prevent flow of plaster out of the filling tube depending on the position of the one-way value. A plastering wedge may be removably coupled at an end of the applicator tube opposing an end of the applicator tube coupled at the applicator hole.

Implementations of an applicator head may include one, all, or any of the following:

The first value may be a ball-type valve that rotatably restricts fluid flow of plaster between an interior and an exterior portion of an applicator head.

The filling tube may include a cross member axially attached to an interior of the filling tube and a stopper where a shaft of the stopper is concentrically received within the filling tube and passes through a hole within the cross member. A spring may be disposed around the stopper shaft and a nut may be threadably coupled onto the stopper shaft where the nut and the cross member may retain the spring around the stopper shaft.

The filling tube may be disposed off-axis from an axis of the applicator tube.

The applicator tube may include a rounded tip and the plastering wedge may releasable snap fit over the rounded tip.

Implementations of plaster applicator devices like those disclosed herein may utilize implementations of methods of filling a plaster applicator device. Method implementations may include closing a first value included in an applicator tube through rotating a first valve handle where the valve restricts fluid flow of plaster between an interior and an exterior of a cone shaped portion of an applicator head. The method may also include coupling a plaster pump hose to the filling tube and applying a second sleeve around a tube coupled to the applicator head thereby preventing moving of the first sleeve along the tube beyond the position of the second sleeve. The method may also include pumping plaster through the plaster pump hose into the filling tube and through a second one-way valve included in the filling tube into the applicator head and thereby into the interior of a tube coupled to the applicator head. The method may also include decoupling the plaster pump hose from the filling tube when a desired quantity of plaster has been pumped into the tube and closing the second one-way valve of the filling tube through spring bias force. The method may also include rotating the first valve handle to open the first value in the applicator tube and permit flow of plaster from the interior of the tube into the applicator tube and removing the second sleeve.

Implementations of the method may include one, all, or any of the following:

The first value may be a ball-type valve which rotatably restricts fluid flow of plaster between an interior and an exterior portion of an applicator head.

Pumping plaster through the pump hose may further include displacing a position of a piston included within the interior of the tube.

The second one-way valve may be opened during pumping plaster through the pump hose into the filling tube.

The connector, through the second sleeve, may provide a frictional resistance to the first sleeve to keep the first sleeve in place during pumping plaster through the plaster pump hose into the filling tube.

The method may further include inserting a plaster applicator rod into the tube prior to pumping plaster through the pump hose into the filling tube.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended plaster applicator device will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such plaster applicator devices, and implementing components and methods, consistent with the intended operation and methods.

Covering the interior walls of both commercial and residential structures is generally done by securing paneling, typically gypsum-based drywall panels in four foot by eight foot sheets, onto the frame of the walls with nails or screws. This process leaves gaps or seams between drywall sheets as well as nail/screw holes that need to be covered so that the wall looks continuously seamless and undamaged. Covering these seams and holes, as well as providing texture to the wall generally is usually done by using plaster. Also called "mud" or "joint compound", plaster can be plaster of Paris, lime plaster or cement plaster. The base materials are mixed with water and other additives as desired to form a thick mixture of mud which, once applied, initiates an exothermic chemical reaction, eventually hardening the mud into a solid form.

Plastering of interior walls where walls meet can involve a multi-step process. In the first step, a plasterer applies tape and mud to the seam between drywall panels. This can either be two or more panels arranged on the same planar surface or two or more panels which are at a 90 degree angle relative to each other and forming the corner of a room. Second, the tape is firmly seated, typically using a roller. The third step is called glazing, which is smoothing out the plaster onto the panels using a head tool, which can be an angle head tool if performed for a corner seam. If the two panels form a corner an additional step can be added with the last step a repeat of step three, using an angle box. In various implementations of plaster applicators disclosed in this document, time and effort may be reduced through allowing various combinations of these steps.

Figure 1:
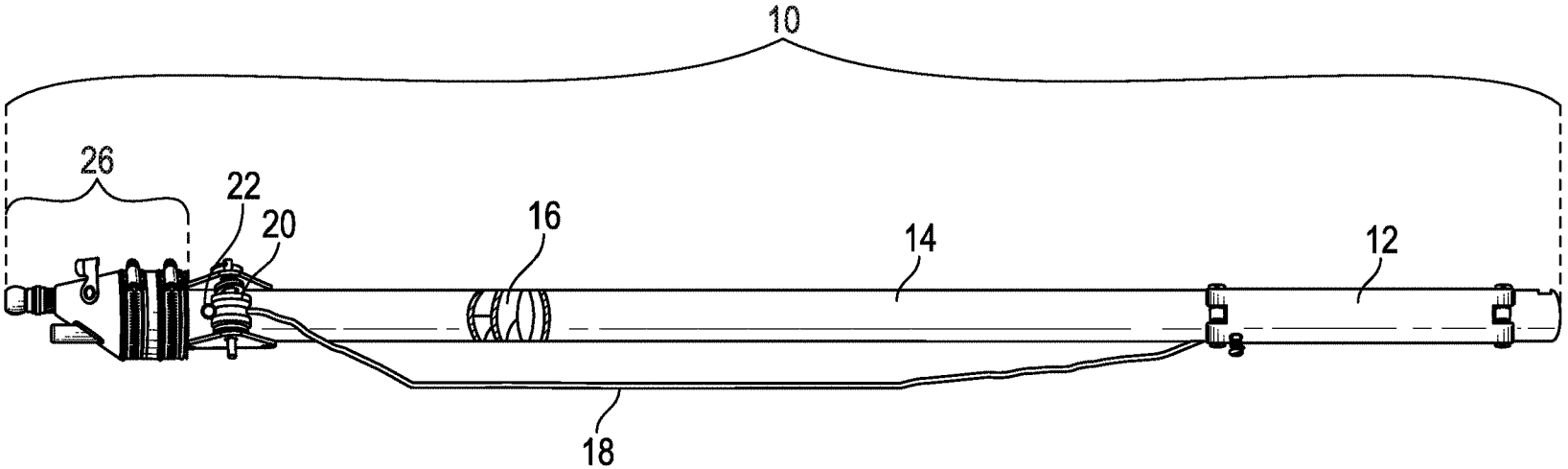
FIG. 1 is a front view of a plaster applicator with filler.

Referring to the drawings, FIGS. 1-9 depict an implementation of a plaster applicator 10. As seen in FIG. 1, the plaster applicator 10 includes a first sleeve 12, and a tube 14 slidably received within the first sleeve 12. A piston 16 is coupled to the first sleeve 12 through a connector 18. The piston 16 is slidably located within the tube 14 as shown in the partial see through portion of the tube 14 so that a sliding movement of the sleeve 12 along the tube 14 creates a sliding movement of the piston 16 within the tube 14. This is accomplished through the connector 18, which can be a cord, wire, cable, or other similar structure. The connector extends from the first sleeve 12 over a first pulley 20 mounted at a first end of the tube 14 through a hole 22 in the tube 14 proximate to the pulley 20, over a second pulley (not shown) inside the tube 14, and then connects to piston 16. Thus, the sliding movement of the sleeve 12 along the tube 14 pulls the connector 18, which pulls the piston 16, and correspondingly operates to extrude plaster contained within the tube 14 between the piston 16 and the applicator head 26.

Figure 3:
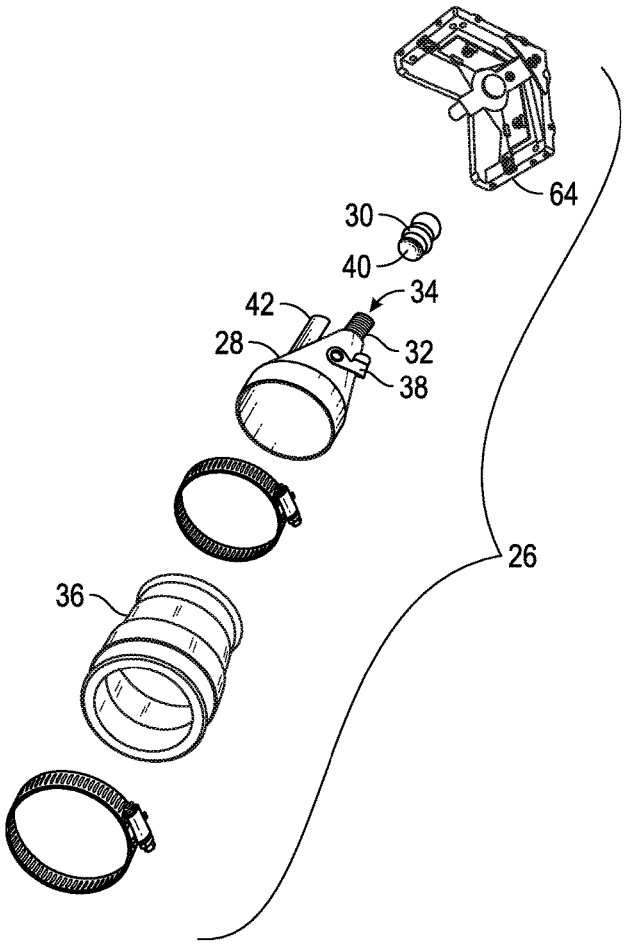
FIG. 3 is an exploded view of a plaster applicator head.
Figure 4:
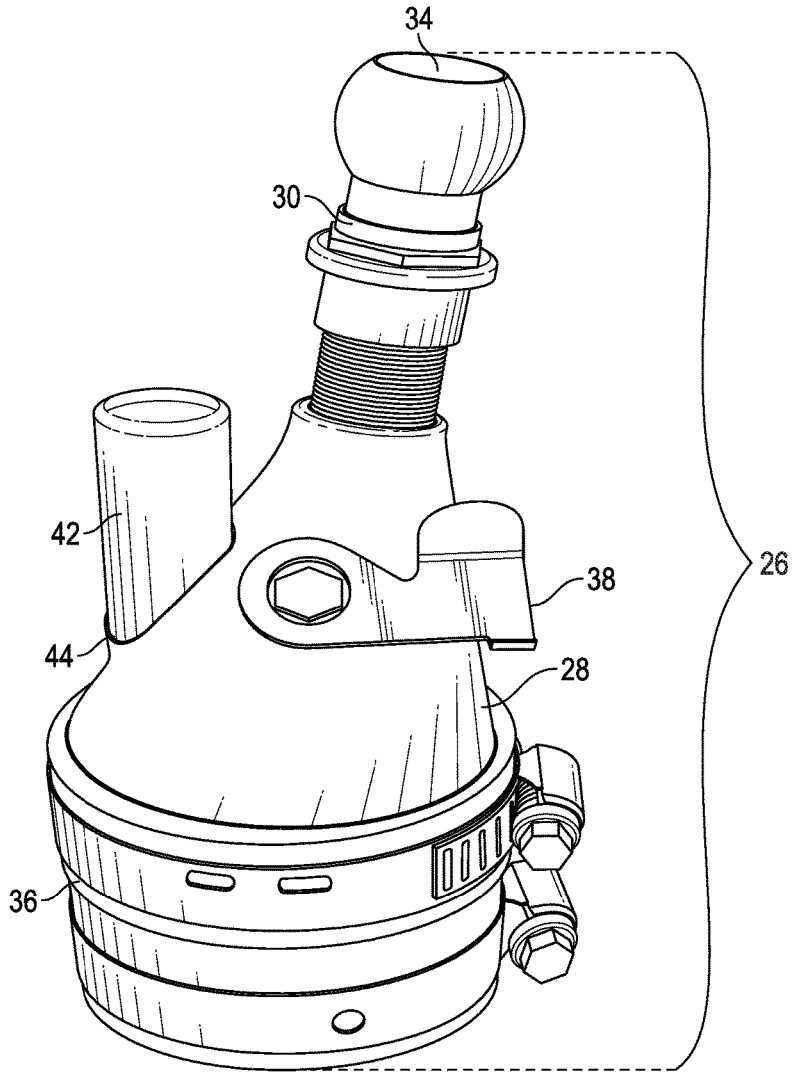
FIG. 4 is a front view of a plastic applicator head.

FIG. 3 illustrates an implementation of an applicator head 26 coupled at the first end of the tube 14. The applicator head 26 can be coupled using, by non-limiting example, through a hose clamp, though other coupling/tightening/clamping mechanisms capable of connecting the head 26 to/into the tube 14 could also be used. As illustrated in FIGS. 1, 3, 4, 7 and 8, the applicator head 26 includes a hollow collar 28, which can be a cone shaped portion of the applicator head 26, the larger diameter end coupled to the first end of the tube 14, and the smaller diameter end threadably connected to a hollow connector 30, the void within collar 28 and the connector 30 connected by an applicator tube 32. The applicator tube 32 is coupled in an applicator hole 34 within the applicator head 26 and the applicator tube 32 configured to provide liquid communication between the interior and the exterior of the applicator tube 32 for plaster in the tube 14.

In various implementations, a collar extender 36 (rubber boot connector), shown in FIGS. 1-4, may be coupled between the collar 28 and the tube 14 that serves to couple the cone shaped portion 28 to the tube 14. As discussed above the collar extender 36 may be connected to both the cone shaped portion 28 and the tube 14 by any coupling systems previously disclosed in this document.

Figure 7:
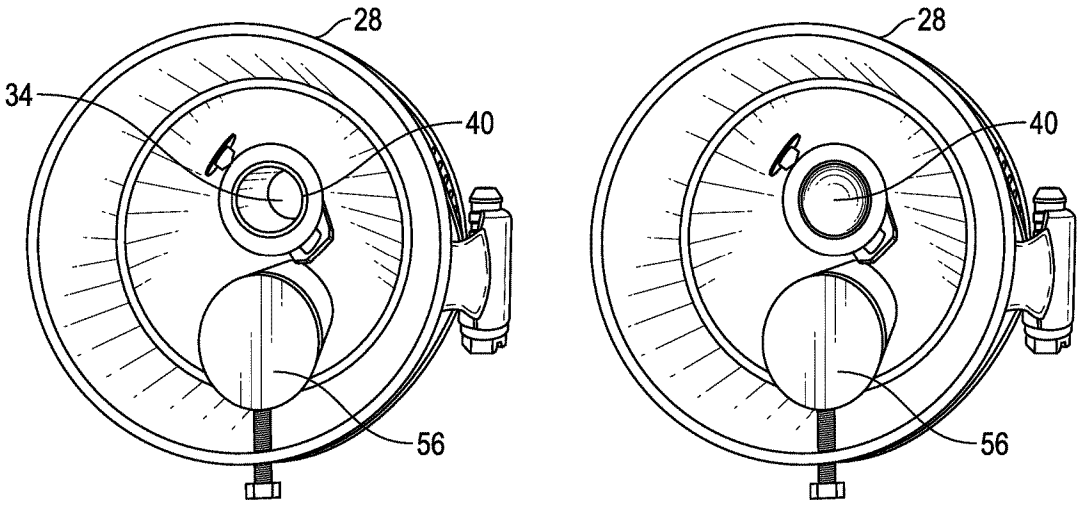
FIG. 7 is a view of a ball valve within the applicator head in both the open and closed position.

A number of the figures (including FIGS. 1, 3, 4, 6 and 8) illustrate a lever 38 that is used to rotate a first valve 40 within the applicator head 26. The lever 38 is used to selectively open and close a first valve 40 within the applicator hole 34 (or otherwise open/close the applicator head) so that, when the tube 14 of the plaster applicator 10 is being re-filled with plaster through the filling tube 42, the plaster will fill the tube 14 instead of exiting through the applicator hole 34. As illustrated in FIG. 7, the lever 38 is shown in the "open" position, meaning that the applicator hole 34 is open and plaster may exit through the applicator 10. When the lever 38 is in the "closed" position, the applicator hole 34 is closed so that plaster may not exit through the applicator hole 34.

As seen in FIGS. 4, 5, 6 and 8, a filling tube 42 is coupled in a filling opening 44 in the applicator head 26, the filling tube 42 configured to provide liquid communication between the interior and the exterior of the tube 14 during filling operations. A second one-way valve 46 is operably connected within the filling tube 42 in the applicator head 26. The one-way valve 46 is configured to allow flow of plaster into the filling tube 42 while preventing flow of plaster out of the filling tube 42 during use of the plaster applicator device to apply plaster.

Figure 5:
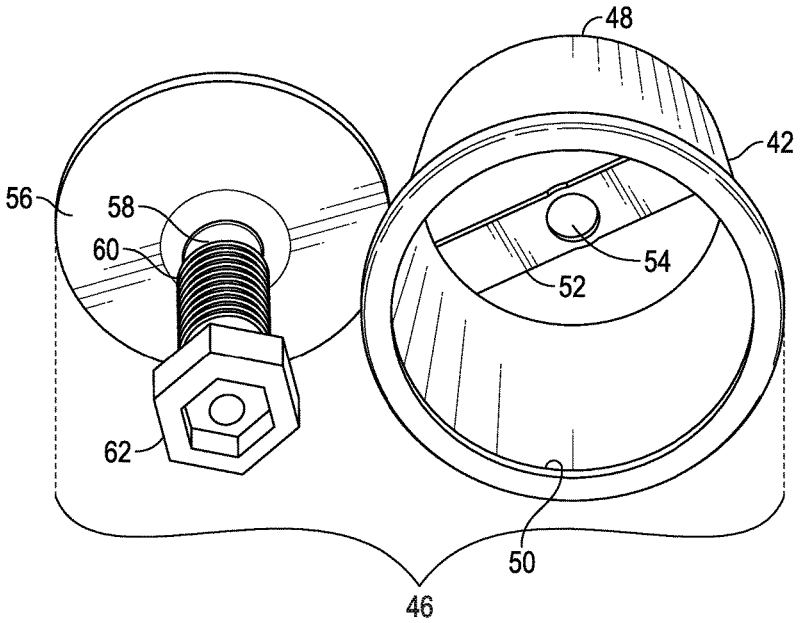
FIG. 5 is a view of an implementation of a filling tube and valve.
Figure 6:
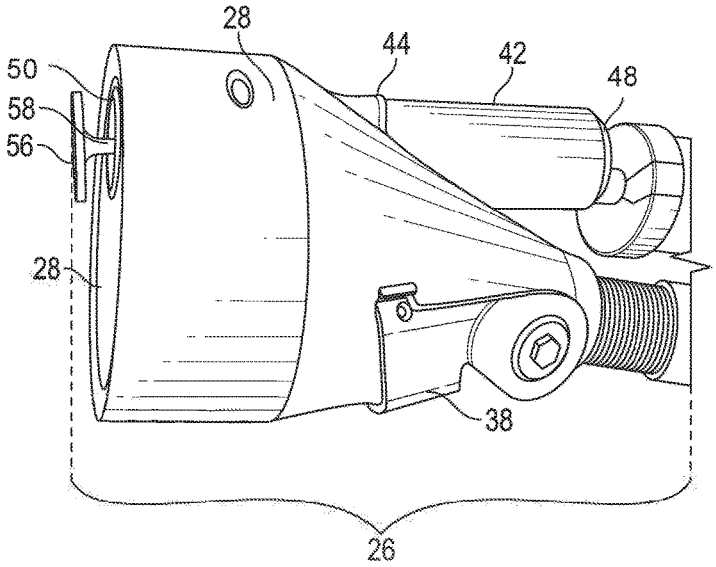
FIG. 6 is a view of a plastic applicator head with the filling tube mechanism in the open position.

Referring again to FIG. 6, the filling tube 42 has an upper opening 48 and a lower opening 50 and houses the one-way valve 46. Referring to FIG. 5, the one-way valve 46 includes a cross member 52 within which is a shaft receiver 54 structurally connected within the filling tube 42. A stopper 56 includes a shaft 58, which is inserted through the lower opening 50 and into the shaft receiver 54. A spring 60 is then placed through the upper opening 48 and over the end of the shaft 58 that extends towards the upper opening 48 through the shaft receiver 54. This results in disposing the spring around the shaft 58. A nut 62 is then placed through the upper opening 48 and coupled with a threaded end of the shaft 58, which retains the spring around the shaft 58 and serves to bias the spring 60 so that it tends to hold the stopper 56 snug against the lower opening 50 as shown in FIG. 7. The bias may be overcome with sufficient pressure force against the stopper to open the lower opening 50, as illustrated is being done manually using a screwdriver in FIG. 6.

Because the stopper 56 is at the lower opening 50 of the filling tube 42, plaster may be pumped into the filling tube 42 from the upper opening 48 to refill the tube 14 of the plaster applicator 10 with plaster. The pressure of the plastering pump is sufficient to open the one-way valve 46. When plaster is being pumped out of the applicator head 26 of the plaster applicator 10 during plaster application, however, the plaster will tend to reinforce the bias of the stopper 56 and keep closed the lower opening 50 of the filling tube 42, so that plaster will not exit the filling tube 42 while plaster is being applied.

Figure 2:
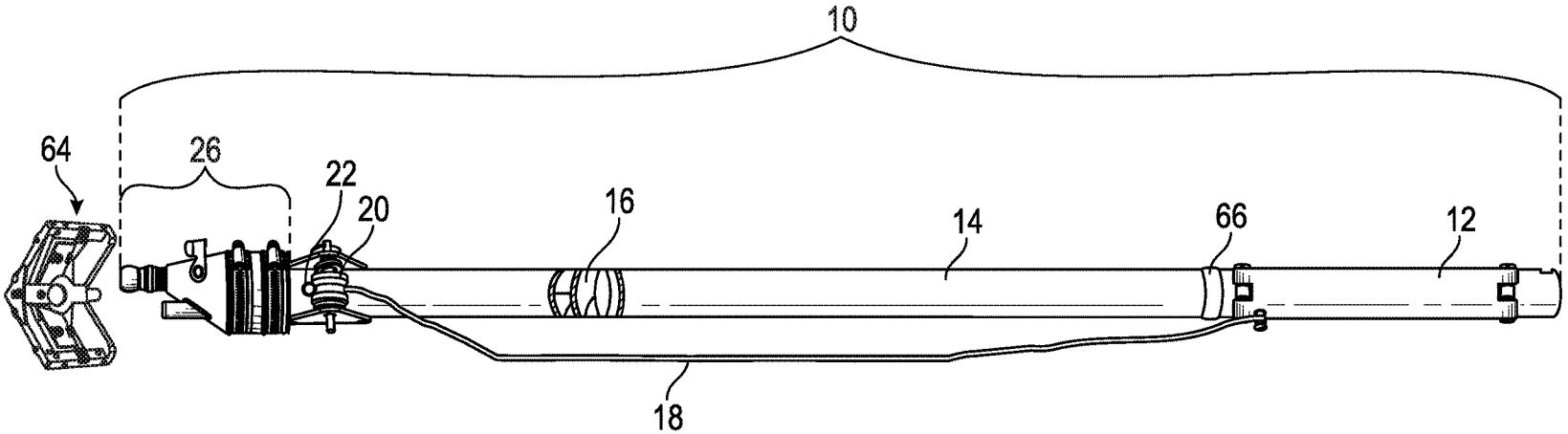
FIG. 2 is a front view of a plaster applicator with filler with a second sleeve coupled thereto and a plastering wedge.
Figure 8:
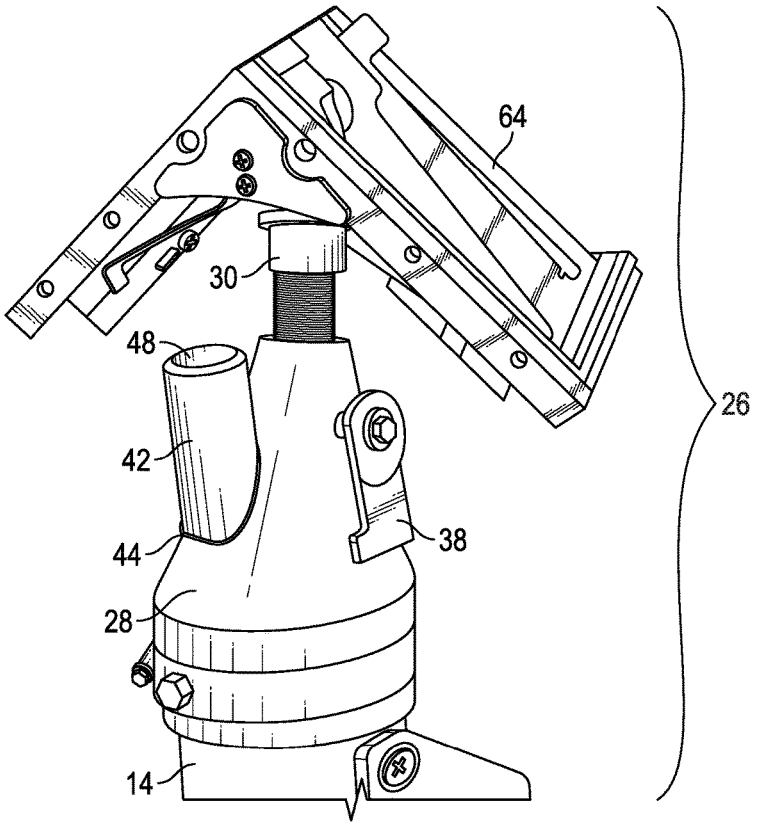
FIG. 8 is a view of an applicator head with valve handle and filling hole with a plastering wedge attached.

As illustrated in FIGS. 2, 3 and 8, implementations of the plaster applicator 10 may further include a plastering wedge 64, which is removably coupled at an end of the connector 30 opposing the end of the connector 30 that is coupled at the applicator hole 34. The plastering wedge 64 may be snapped/popped onto the connector 30 and is to some extent moveable/rotatable thereon so that plaster/mud may be dispensed through the applicator head 26 and through one or more openings in the wedge 64 to apply plaster to a corner where two walls meet. In other implementations, however, the wedge 64 may be excluded, or another snap-on attachment may be included, and the applicator 10 may be used for a plaster application process other than applying plaster to an angle, such as applying plaster to a flat portion of a wall, or corner, and so forth. In the various device and method implementations disclosed herein, the plastering wedge 64 may not need to be removed during the filling operations at all, but may remain removably coupled to the end of the connector 30 throughout the filling process.

Figure 9:
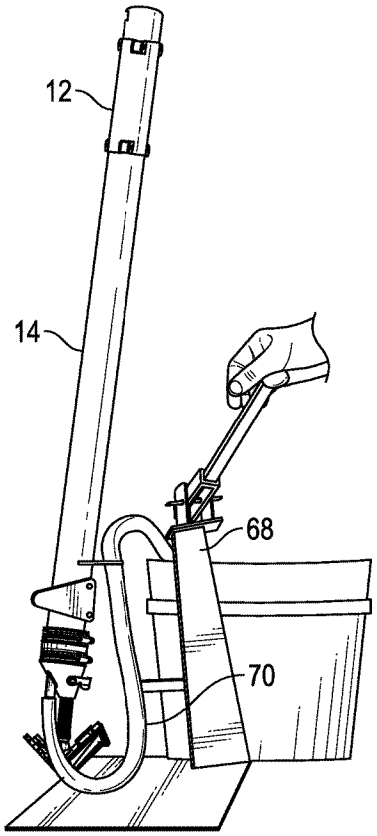
FIG. 9 is a view of a plaster applicator in the process of being filled with plaster.
Figure 9:
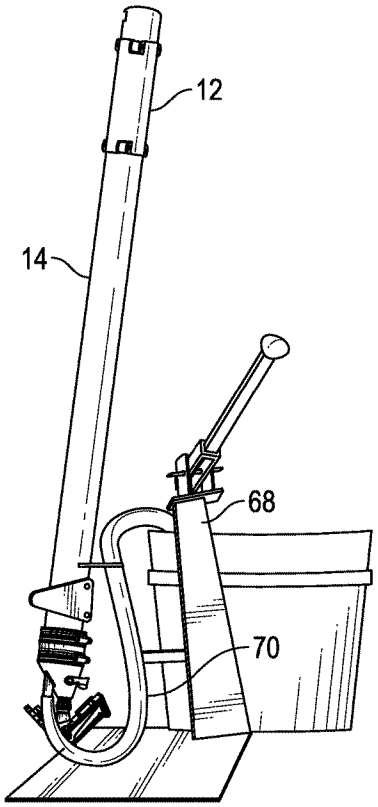

Also depicted in FIGS. 2 and 9, a second connector or sleeve 66 may be coupled over the tube between the first sleeve 12 and the applicator head, thereby preventing movement of the first sleeve 12 along the tube 14 beyond the position of the second sleeve 66. The second sleeve may couple over the tube using hook and loop fastener or another radial tightening structure. This second sleeve 66 can accomplish this through having a clamping type action create enough frictional force onto the tube 14 to keep both sleeves in place, despite the other forces being applied onto them. The use of the second sleeve may aid in allowing the piston to move freely without having to push the weight of the first sleeve during filling operations.

FIG. 9 shows a plaster applicator 10 having the elements described herein coupled with a pump 68 to fill the tube 14 with plaster. The pump 68 has a pump tube 70 that couples with the previously-described filling tube 42, and the user first rotates the lever 38 of the first valve 40 on the applicator head 26 to close the first valve. This prevents plaster pumped into tube 14 from exiting through the applicator head 26 during the filling process. The user then couples the second sleeve 66 onto the first sleeve 12 in order to keep the first sleeve 12 in place at the top of the tube so that, during the pumping process, the first sleeve 12 does not have to be pushed along with the piston inside the tube 14. This may also prevent the connector 18 from binding or tangling during filling.

The user then uses the pump 68 to manually pump plaster into the tube 14 through the filling tube. As this is done, in some implementations, the first sleeve 12 moves down the tube 14 due to the tube 14 filling with plaster and the piston 16 being forced upwards, pulling on the cable connector that couples the piston 16 with the sleeve 12, and accordingly pulling the first sleeve 12 downwards as has been described working against the frictional forces created by the second sleeve 66 to keep the first sleeve 12 from coming down too rapidly. During this process, the force of the plaster from the pump opens the second one-way valve in the filling tube allowing the plaster to enter the interior of the tube 14. In various implementations, an automated or electric pump could also be used.

Once the tube 14 has been filled with plaster, and the pumping pressure stops, the spring bias of the second one-way valve closes the valve. The user may de-couple the plaster pump hose 70 from the filling tube 42, and turn the lever 38 for the first valve 40 on the applicator head 26 to the open position. The second sleeve is then removed from the tube 14, allowing the first sleeve 12 to move as desired. The plaster applicator 10 is now ready for use to apply plaster/mud to a surface once a plastering wedge is coupled to the end of the applicator tube.

Figure 10:
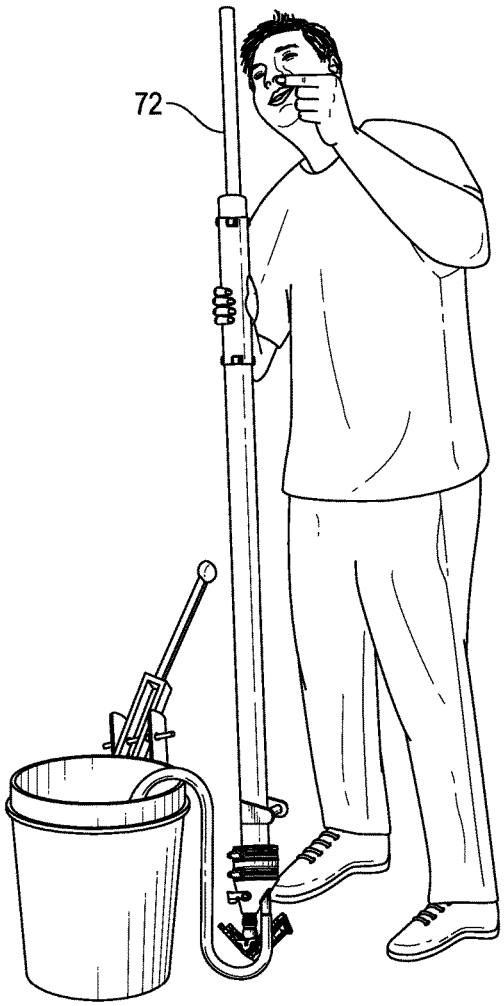
FIG. 10 is a view of an applicator rod inserted into a tube of a plaster applicator during the filling operation.

Referring to FIG. 10, an applicator rod 72 is illustrated inserted into the tube of a plaster applicator and resting on the piston 16 during the filling operation. The applicator rod 72 is used during application of plaster to help the user push the piston 16 inside the tube 14 toward the applicator head 26 end of the tube 14 while the user simultaneously pulls downwardly on the first sleeve 12. In this way, additional force can be applied by the user to the piston 16 to push plaster out of the applicator 10 during application of plaster. During filling, the applicator rod 72 can still remain in the tube 14 and moves upwardly during the filling process.

Although specific representative examples of plaster applicator devices and implementing components are described herein, a number of modifications may be made to such devices while still accomplishing the same quick-fill mechanism. For example, some other type of one-way valve or other device that is different from the stopper may be used to ensure that plaster is allowed to flow through the filling tube and into the tube during a plaster refill process but not out of the filling tube during application of plaster to a wall/corner, etc. For example, some other type of one-way valve could be implemented, or a slidable stopper or plug could be put in place and coupled with the filling tube during a plaster application process to prevent the plaster from escaping through the filling tube.

It may be seen in some of the figures, particularly FIGS. 3, 4 6 and 8, that the smaller diameter end of the applicator collar is offset from the center of the tube at an angle with the use of an offset collar, and that the fill tube is also slightly offset. In other implementations one or more of the applicator and/or fill tube could be not offset and/or the collar could not have an offset configuration. As also illustrated, the filling tube may be off-axis from an axis of the applicator tube in various implementations.

In implementations some of the components could be integrally formed together instead of being separately formed pieces that are later assembled. For example the fill tube could be formed of a polymer and integrally formed with the collar instead of being a separate metal insert that is inserted into a hole of the collar. Likewise, while the lever, washer, screw/bolt, and threaded lever shaft are all shown as separately formed elements which are later assembled, in implementations they could all be integrally formed as a single piece, or the ball shaft and threaded lever shaft could be integrally formed as a single piece, and so forth. These elements could be formed of metals, as shown in the figures, or of polymers, composites, ceramics, and so forth.

In some cases the lever could be configured to operate a valve that opens a flow path between the filling tube and large tube and simultaneously closes a flow path from the large tube through the applicator, and vice versa. In such an implementation, there may be no stopper (and related elements) needed with the fill tube to ensure that plaster does not exit the fill tube during application, because the rotation of the lever to the proper configuration to apply plaster would then also close off the fill tube. This could be accomplished, for example, by the use of a single three-way valve, where turning or setting the valve at a first setting opens the fill tube and closes the applicator, and turning or setting the valve at a second setting closes the fill tube and opens the applicator.

Further, although specific examples of elements are shown for the lever and ball valve design, it may be understood that any number of modifications or alternative valve elements could be used to accomplish this same closure/opening. For example, the lever shown in the drawings is rotated to turn a ball valve, but a different movement (a linear movement instead of a rotation) could be used to operate a valve, and a valve type different than a ball valve could be used, and so forth. The practitioner of ordinary skill in the art will understand various ways to accomplish the closure and opening of the applicator using a variety of mechanisms, using a greater or fewer number of elements/sub-elements/components than are described herein, and so forth.

The design of the plaster applicator with the fill tube, as described herein, may allow a user to more quickly fill the tube of the plaster applicator after the tube has been emptied without having to remove the wedge each time the applicator is filled with plaster. This may increase productivity of workers, decrease time spent on a plaster application job, decrease money spent on a plaster application job, and so forth.

The plaster applicator with filling mechanism and related methods may be made of conventional materials used to make goods similar to these in the art, such as, by non-limiting example, polymers, ceramics, metals, rubbers, composites, and the like. Those of ordinary skill in the art will readily be able to select appropriate materials and manufacture these products from the disclosures provided herein.

In places where the description above refers to particular implementations of plaster applicator devices and implementing components, sub-components, methods and sub-methods, it should be readily apparent that a number of modifications may be made without departing from the spirit thereof and that these implementations, implementing components, sub-components, methods and sub-methods may be applied to other plaster applicator devices.

What is claimed is:

1. A plaster applicator device comprising:

a first sleeve;

a tube slidably received within the first sleeve;

a piston coupled to the first sleeve through a connector, the piston slidably located within the tube so that a sliding movement of the sleeve along the tube creates a sliding movement of the piston within the tube where the connector extends over a pulley mounted at a first end of the tube and through a hole in the tube proximate to the pulley;

an applicator head coupled at the first end of the tube, the applicator head comprising an applicator tube coupled in an applicator hole in the applicator head, the applicator tube configured to provide liquid communication between the interior and the exterior of the tube for plaster comprised in the tube;

a first valve operably connected within the applicator head, the valve restricting fluid flow of plaster between an interior and an exterior portion of an applicator head;

a filling tube coupled in a filling opening in the applicator head, the filling tube configured to provide liquid communication between the interior and the exterior of the tube;

a second one-way valve operably connected within the filling tube in the applicator head, the second one-way valve configured to allow flow of plaster into the filling tube and prevent flow of plaster out of the filling tube depending on the position of the second one-way valve; and a plastering wedge removably coupled at an end of the applicator tube opposing an end of the applicator tube coupled at the applicator hole.

2. The plaster applicator device of claim 1, wherein a second sleeve is coupled to the tube thereby preventing movement of the first sleeve along the tube beyond the position of the second sleeve.

3. The plaster applicator device of claim 1 wherein the connector is a wire.

4. The plaster applicator device of claim 1 wherein a gasket is coupled to the piston thereby preventing liquid communication between the front and the rear of the piston.

5. The plaster applicator device of claim 1, wherein the applicator head comprises a cone-shaped portion, the applicator hole being positioned at a tip of the cone-shaped portion.

6. The plaster applicator device of claim 5, wherein the applicator tube comprises a rounded tip and the plastering wedge releasably snap fits over the rounded tip.

7. The plaster applicator device of claim 1, wherein the first valve is a ball-type valve which rotatably restricts fluid flow of plaster between an interior and an exterior portion of an applicator head.

8. The plaster applicator device of claim 1, wherein the filling tube comprises:

a cross member axially attached to an interior of the filling tube;

a stopper, wherein a shaft of the stopper is concentrically received within the filling tube and passes through a hole within the cross member;

a spring disposed around the stopper shaft; and a nut threadably coupled onto the stopper shaft, the nut and the cross member retaining the spring around the stopper shaft.

9. The applicator head of claim 1, wherein the filling tube is disposed off-axis from an axis of the applicator tube.

10. An applicator head for a plaster applicator device comprising:

a cone shaped portion comprising an applicator hole positioned at an end of the cone shaped portion, the cone shaped portion coupled to a cylindrical portion and the cylindrical portion configured to be mounted to a first end of a tube and the applicator hole comprising an applicator tube coupled therein, the applicator tube configured to allow liquid communication for plaster between the interior and the exterior of the tube;

a first valve operably connected within the applicator head, the first valve restricting fluid flow of plaster between an interior and an exterior portion of an applicator head;

a filling tube coupled in a filling opening in the cone shaped portion, the filling tube configured to permit liquid communication for plaster between the interior and exterior of the cone shaped portion;

a second one-way valve coupled in the filling tube, the one way-valve configured to allow flow of plaster into the filling tube and prevent flow of plaster out of the filling tube depending on the position of the one-way valve; and a plastering wedge removably coupled at an end of the applicator tube opposing an end of the applicator tube coupled at the applicator hole.

11. The applicator head of claim 10, wherein the first valve is a ball-type valve that rotatably restricts fluid flow of plaster between an interior and an exterior portion of an applicator head.

12. The applicator head of claim 10 wherein the filling tube comprises:

a cross member axially attached to an interior of the filling tube;

a stopper, wherein a shaft of the stopper is concentrically received within the filling tube and passes through a hole within the cross member;

a spring disposed around the stopper shaft; and a nut threadably coupled onto the stopper shaft, the nut and the cross member retaining the spring around the stopper shaft.

13. The applicator head of claim 10, wherein the filling tube is disposed off-axis from an axis of the applicator tube.

14. The applicator head of claim 10, wherein the applicator tube comprises a rounded tip and the plastering wedge releasably snap fits over the rounded tip.

15. A method for filling a plaster applicator device, the method comprising:

closing a first valve comprised in an applicator tube through rotating a first valve handle, the first valve restricting fluid flow of plaster between an interior and an exterior of a cone shaped portion of an applicator head;

coupling a plaster pump hose to the filling tube;

preventing movement of a first sleeve along a tube beyond a position of a second sleeve by applying a second sleeve around the tube, the tube coupled to the applicator head;

pumping plaster through the plaster pump hose into the filling tube and through a second one-way valve comprised in the filling tube into the applicator head and thereby into the interior of a tube coupled to the applicator head;

decoupling the plaster pump hose from the filling tube when a desired quantity of plaster has been pumped into the tube;

closing the second one-way valve of the filling tube through spring bias force;

rotating the first valve handle to open the first valve in the applicator tube and permit flow of plaster from the interior of the tube into the applicator tube; and removing the second sleeve.

16. The method of claim 15, wherein the first valve is a ball-type valve which rotatably restricts fluid flow of plaster between an interior and an exterior portion of an applicator head.

17. The method of claim 15, wherein pumping plaster through the pump hose further comprises displacing a position of a piston comprised within the interior of the tube.

18. The method of claim 15, wherein the second one way valve is opened during pumping plaster through the pump hose into the filling tube.

19. The method of claim 15, wherein a connector, through the second sleeve, provides a frictional resistance to the first sleeve to keep the first sleeve in place during pumping plaster through the plaster pump hose into the filling tube.

20. The method of claim 15, further comprising inserting a plaster application rod into the tube prior to pumping plaster through the pump hose into the filling tube.

* * * * *